US007703850B1

(12) United States Patent
Bell

(10) Patent No.: US 7,703,850 B1
(45) Date of Patent: Apr. 27, 2010

(54) RETROFIT HEIGHT ADJUSTABLE SEAT

(76) Inventor: Dale A. Bell, 1260 Walnut Valley La., Washington Township, OH (US) 45458

( * ) Notice: Subject to any disclaimer, the term of this patent is extended or adjusted under 35 U.S.C. 154(b) by 5 days.

(21) Appl. No.: 12/146,574

(22) Filed: Jun. 26, 2008

(51) Int. Cl.
*A47C 1/00* (2006.01)

(52) U.S. Cl. ..... 297/344.12; 297/338

(58) Field of Classification Search ..... 297/338, 297/344.12, 256.11, 255, 256
See application file for complete search history.

(56) References Cited

U.S. PATENT DOCUMENTS 1,127,413 A * 2/1915 Davis ..... 297/338 X
3,669,492 A * 6/1972 Peterson ..... 297/256 X
3,968,991 A 7/1976 Maclaren
4,527,829 A 7/1985 Fanslau et al.
5,074,620 A * 12/1991 Jay et al. ..... 297/338
5,112,076 A 5/1992 Wilson
5,123,699 A * 6/1992 Warburton ..... 297/256
5,346,279 A * 9/1994 Pecorella ..... 297/256.11
5,437,497 A * 8/1995 Hutson ..... 297/338
5,695,248 A 12/1997 Bell
6,123,306 A 9/2000 Jackson
6,250,717 B1 6/2001 Porcheron
6,279,998 B1 * 8/2001 Chu et al. ..... 297/338
7,338,125 B2 * 3/2008 Grabowski ..... 297/338
2004/0070251 A1 4/2004 Roney et al.

* cited by examiner

*Primary Examiner*—Anthony D Barfield
(74) *Attorney, Agent, or Firm*—R. William Graham

(57) ABSTRACT

A retrofit height adjustable seat for a chair having a support frame includes a base for connection to the support frame, a seat movably connected to the base by a displacement mechanism, a bracket connected to the base and an elastic member removably connected to the bracket and for interconnecting the seat to the support frame, thereby positionally securing the seat to the support frame. A collapsing seat back with pivoting arms is also provided.

11 Claims, 5 Drawing Sheets

RETROFIT HEIGHT ADJUSTABLE SEAT

BACKGROUND OF INVENTION

1. Field of Invention

This invention concerns improvements in or relating to a retrofit height adjustable seat primarily for use on a chair and like apparatus for raising and lowering a seat of a chair.

2. Related Art

The present invention is an improvement over the teachings in U.S. Pat. No. 5,695,248 which pertained to a retrofit adjustable seat for connection to a conventional wheelchair having a frame, wheels, a wheelchair seat and back operably connected thereto. Such a seat comprised a base with releasable connector for connecting the base to the frame of the wheelchair, a retrofit seat, and an elevator operably connecting the base and the retrofit seat for adjustably elevating the retrofit seat to a selectable height.

Even with the improvements made to the art, the prior invention did not lend itself to ready use on various types of chairs and there remained a need to improve the art. Further, there is a need for a retrofit height adjustable seat for a chair which allows for easy collapsible operation and ease of use for various types of chairs.

BRIEF SUMMARY OF INVENTION

It is an object to improve retrofit height adjustable seats.

It is another object to provide an improved retrofit height adjustable seat for a chair with storage integration and mobility enhancing features.

It is yet another object to provide improved versatility of connection to a retrofit height adjustable seat for a chair.

Accordingly, the invention is directed to a retrofit height adjustable seat for a chair having a support frame. The seat includes a base for connection to the support frame, a seat movably connected to the base by a displacement mechanism, a bracket connected to the base and an elastic member removably connected to the bracket and for interconnecting the seat to the support frame, thereby positionably securing the seat to the support frame. The retrofit height adjustable seat further includes a collapsing seat back connected to the seat with fixably adjustable arms connected to the collapsing seat back.

DETAILED DESCRIPTION OF THE INVENTION

Figure 1:
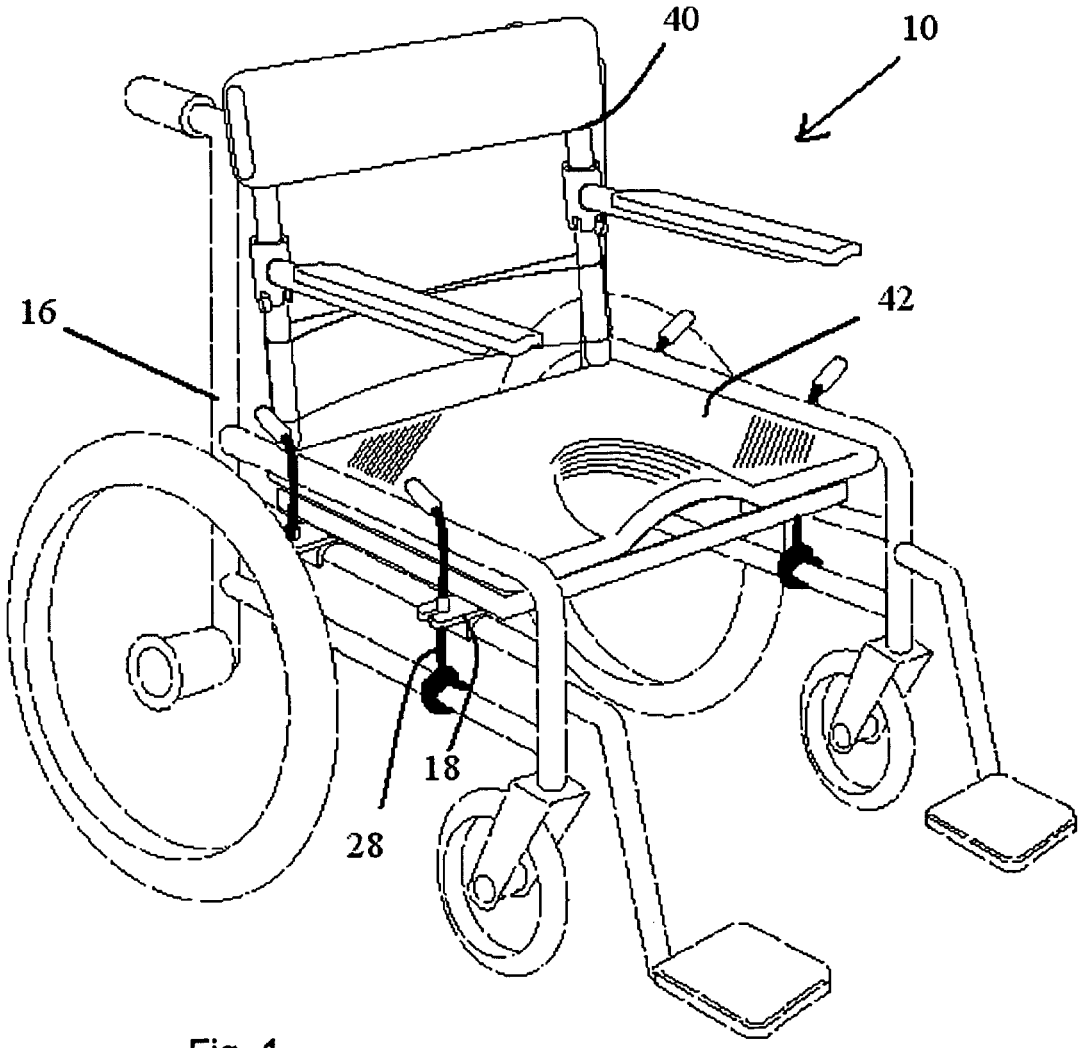
FIG. 1 is a perspective view of a retrofit height adjustable seat featuring the present invention.

Referring to the drawings, a retrofit height adjustable seat is generally designated by the number 10. The retrofit height adjustable seat 10 includes a base 12 which can be connected to support frame members 14 of a wheelchair 16 through use of brackets 18 and elastic members 28 which fixably connect the base 12 to the support frame members 14. The brackets 18 may be formed of any resilient and strong material, preferably a light weight metal, aiding ease of portability along with strength. It is also contemplated that the brackets 18 can be integrally formed as part of the base 12.

The figures depict the brackets 18 as having a generally planar and elongated surface portion 20 having a notch 22 therein and an angle stop portion 24 connected to portion 20. A base connection interface is achieved through the use of openings 26 in bracket 18 and screws (not shown) which secure the brackets 18 to the base 12. It is contemplated that other means for connection between the base 12 and brackets 18 can be employed. By way of example, there are four brackets 18 employed, but the number and position can be varied to accommodate the seat/chair combination.

Figure 2A:
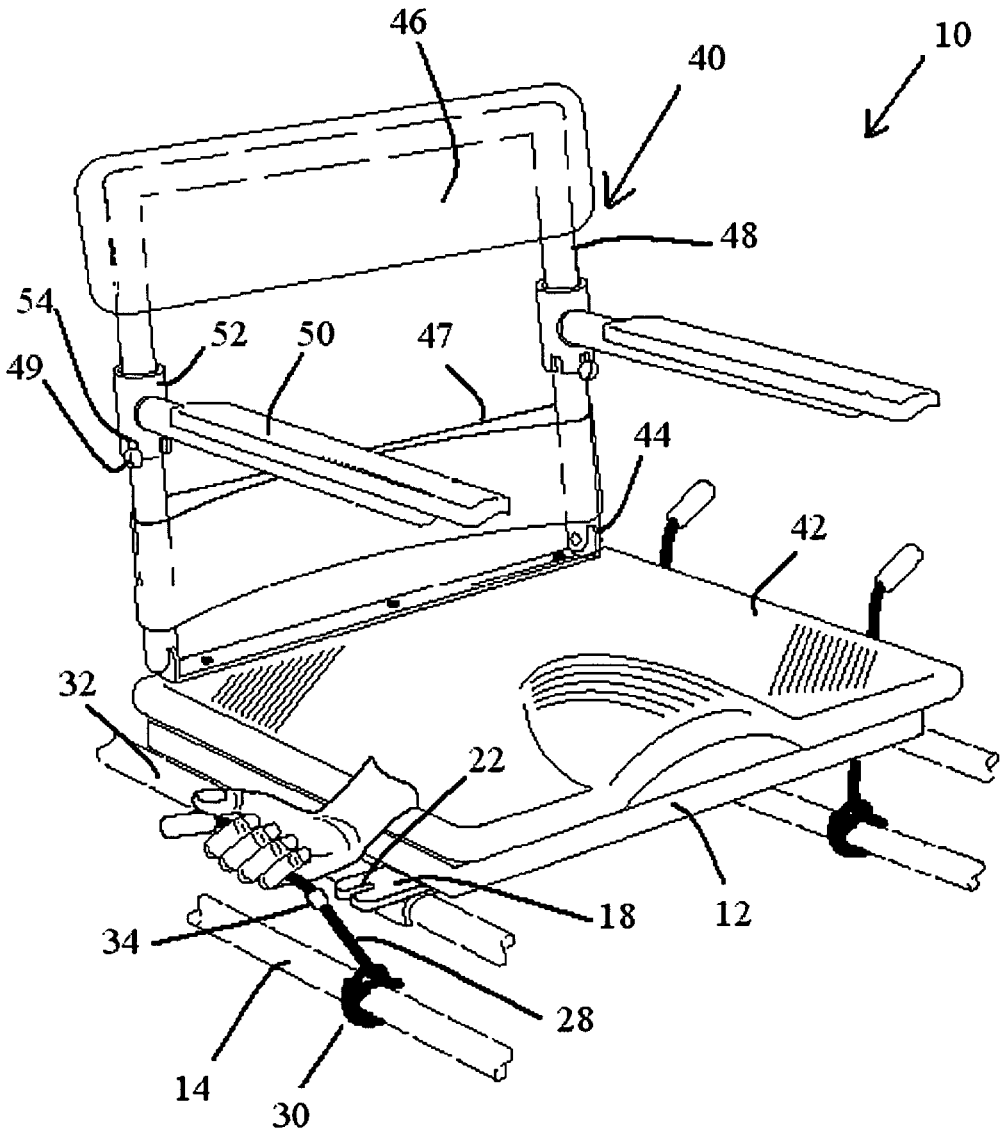
FIG. 2*a* is a perspective view of a chair frame with the retrofit height adjustable seat featuring the implementation of a mode of use of the present invention.
Figure 2B:
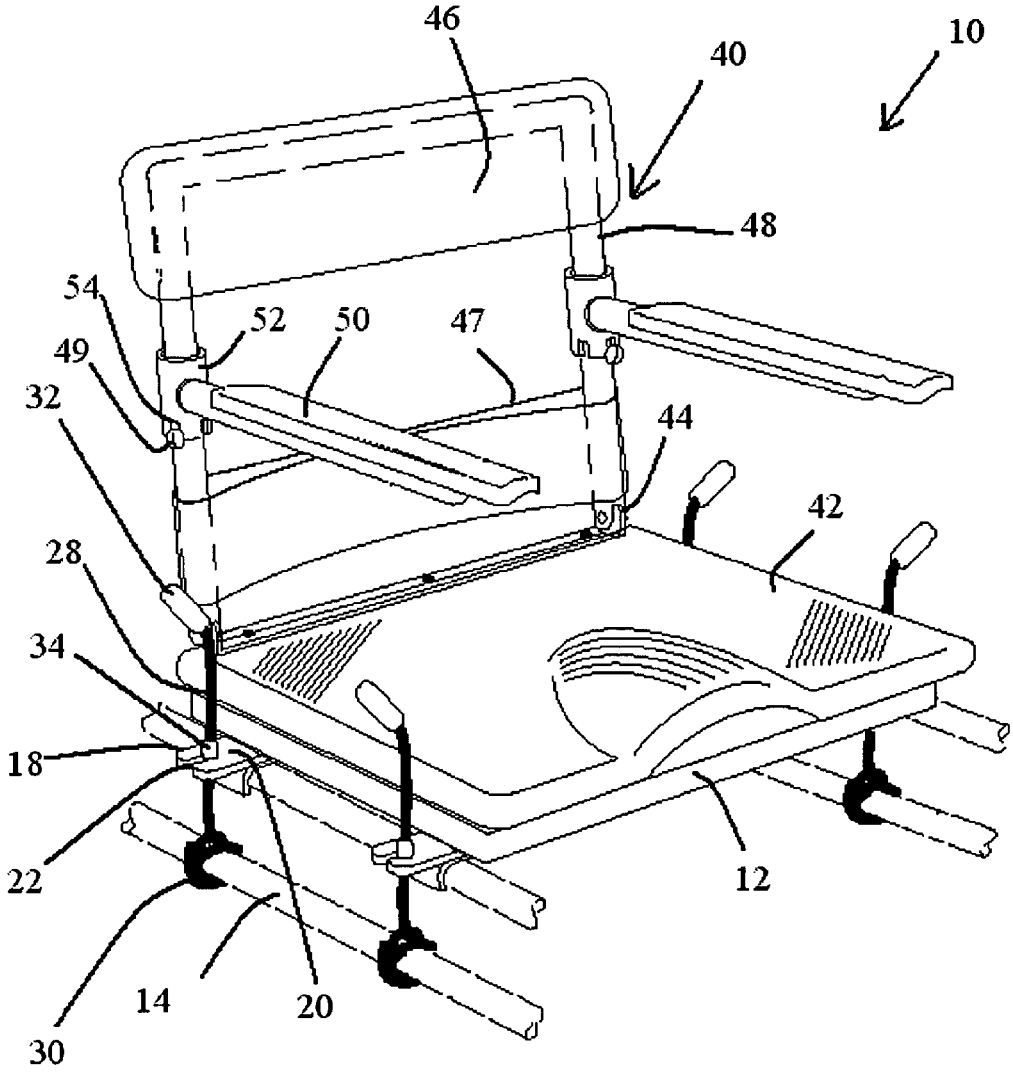
FIG. 2*b* is a perspective view of a chair frame with the retrofit height adjustable seat connected thereto.
Figures 3, 4:
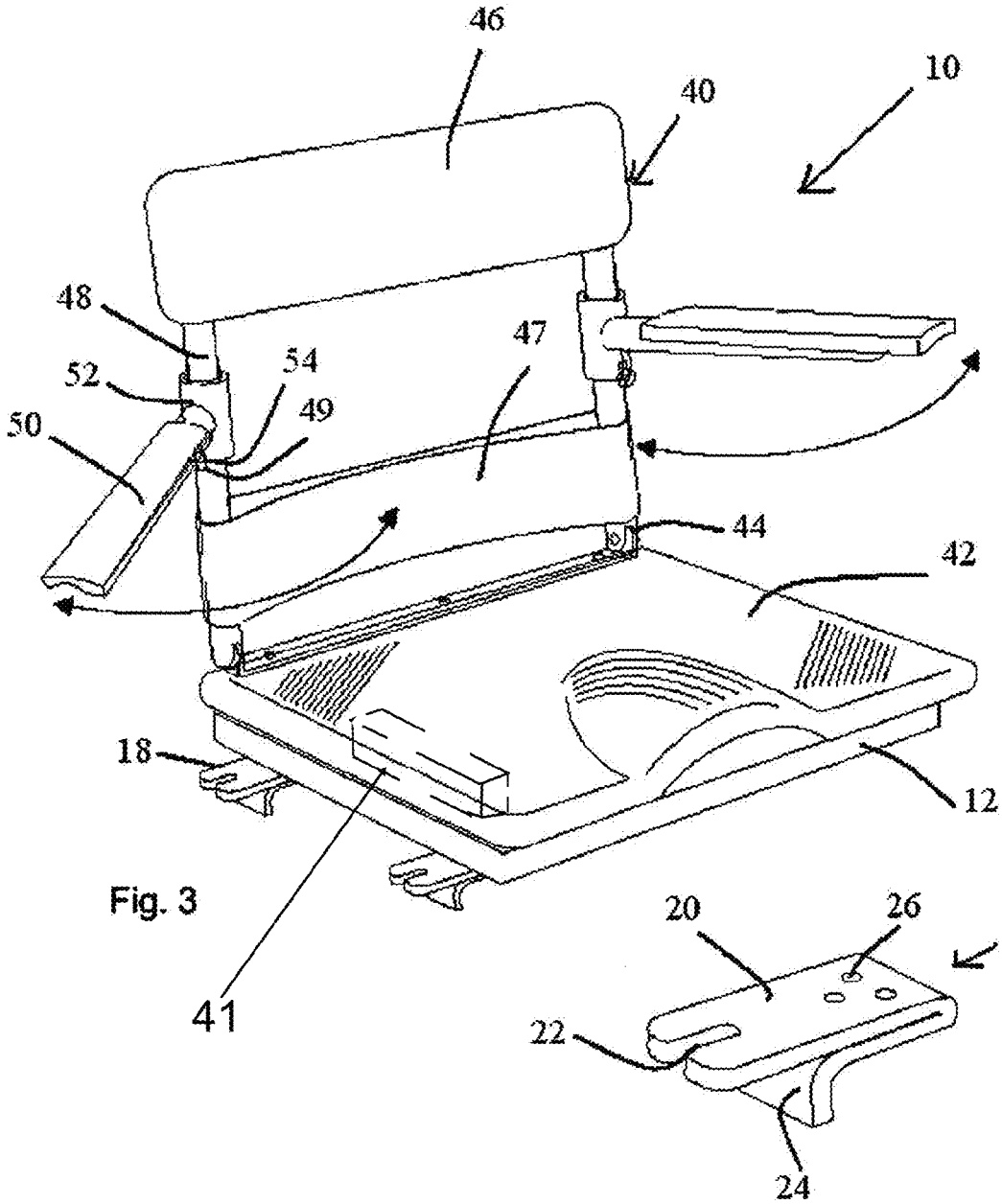
FIG. 3 is a perspective view of another embodiment retrofit height adjustable seat of the present invention emphasizing arm swivel and movement.
FIG. 4 is a perspective view of a bracket in the present invention.
Figure 5:
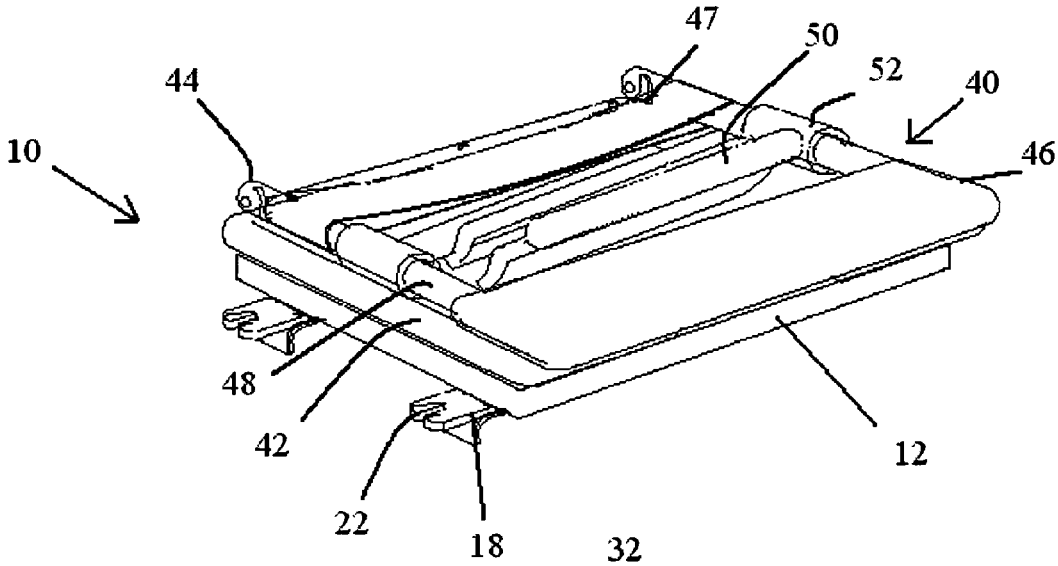
FIG. 5 is a perspective view of another mode of use showing a collapsed form for mobility and storage for the retrofit height adjustable seat of the present invention.
Figure 6:
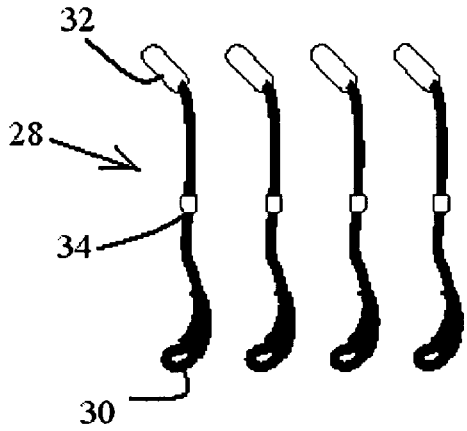
FIG. 6 is a perspective view of elastic members of the present invention.

FIG. 6 thus shows four elastic members 28 for use with brackets 18, wherein each elastic member 28 includes a looped end 30, a handle end 32 and an a fixably adjustable piece 34, such as a malleable ring of copper, for example, disposed about the elastic member 28. Looped end 30 can be connected about the support frame 14 as seen in FIGS. 1 and 2 with the handle end 32 inserted through the looped end 30 thereby encircling the support frame 14. Elastic member 28 has a diameter to fit within notch 22. Handle end 32 can be used to pull and create tension and elastic member 28 can be inserted through the bracket notch 22.

Thus, as handle end 32 is pulled, the elastic member 28 is under tension and with the adjustable piece 34 held above the notch 22 and in contact with portion 20, the piece 34 can be fixed to the elastic member 28 (e.g., by crimping copper ring) such that a point of connection is created with the bracket 18 whereby the base 14 is forcibly held to the support frame 14 through the tension of the elastic member 28 and described interconnection. The brackets 18 can preferably be commonly positioned in symmetric manner about the base 12 or as otherwise may be conducive to permit the elastic members 28 to be connected to the support frame 14.

A collapsible seat back 40 is hingedly connected to a seat 42 which is movably connected to base 12 by a displacement mechanism 41 which can be a scissors jack, hydraulic or similar elevator. The seat back 40 will allow the retrofit height adjustable seat to collapse and fold in a compact manner. A limiting hinge mechanism 44 provides for the seat back 40 to move between an upright or normal position and a collapsed or folded position whereupon the seat back 40 is folded flat against the seat 42. The seat back 40 has upper transverse support pad 46 and lower lumbar strap 47 interconnecting side frame members 48.

Pivoting arms 50 can preferably be axially movable on the seat back frame members 48 and include a T-shaped tubular connector 52 which includes a plurality of radially spaced notches 54 to receive a pin 49 which extends outward from the frame member 48. The arms 50 can thus move axially free of the pin 49 and notch 54 connections so that the arms 50 are free to rotate about the frame members 48. The arms 50 can pivot to lie flat and in generally the same plane as a plane spanned by the seat back 40. Also, each pivoting arm 50 can be provided onto pin 49 via notch 54 in connector 52 to provide for various fixed arm widths enabling use of various sized users.

While the present invention has been set forth above in a preferred embodiment, it is contemplated that other modifications, improvements and derivations will be readily apparent to those skilled in the art. For example, it is contemplated that the elastic base end could be alternatively designed to connect to the base of the seat, such that handle end is looped under the chair support frame and the elastic member can be brought into a notch on such bracket. Accordingly, the appended claims hereto should be accorded the full scope of protection of any such modifications, improvements and derivations.

What is claimed is:

1. A retrofit height adjustable seat for a chair having a support frame, which includes:

a base for connection to the support frame;

a seat movably connected to said base by a displacement mechanism;

a bracket connected to said base; and an elastic member removably connected to said bracket, and for interconnecting said seat to the support frame, wherein said elastic member includes a base end for connection to the support frame and a handle end for connecting a intermediate portion of said elastic member to said bracket thereby positionably securing said seat to the support frame.

2. The retrofit height adjustable seat of claim 1, which further includes a collapsing seat back connected to said seat.

3. The retrofit height adjustable seat of claim 2, which further includes fixably adjustable arms connected to said collapsing seat back.

4. The retrofit height adjustable seat of claim 1, wherein said bracket includes a notch to removable receive said intermediate portion said elastic member.

5. A retrofit height adjustable seat for a chair having a support frame, which includes:

a base for connection to the support frame;

a seat movably connected to said base by a displacement mechanism;

a bracket connected to said base; and an elastic member removably connected to said bracket, and for interconnecting said seat to the support frame, wherein said elastic member includes a base end for connection to the support frame, a handle end, and a fixably adjustable piece between said ends wherein said fixably adjustable piece provides a point of connection to said bracket and when said base end is connected to the support frame and said fixably adjustable piece is connected to said bracket, said elastic member is under tension to positionably retain said base to said support frame.

6. The retrofit height adjustable seat of claim 5, which further includes a collapsing seat back connected to said seat.

7. The retrofit height adjustable seat of claim 6, which further includes fixably adjustable arms connected to said collapsing seat back.

8. The retrofit height adjustable seat of claim 5, wherein said bracket includes a notch to removable receive said elastic member.

9. A retrofit height adjustable seat for a chair having a support which includes:

a base for connection to the support frame;

a seat movably connected to said base by a displacement mechanism;

a collapsing seat back hingedly connected to said seat in a manner such that said seat back moves from a generally normal position with respect to said seat to a generally parallel and flat collapsed position with respect to said seat; and fixably adjustable arms connected to said collapsing seat back in a manner such that said arms pivot from a generally normal position with respect to said seat back to a generally parallel and flat collapsed position with respect to said seat back, which further includes a bracket connected to said base and an elastic member removably connected to said bracket and for interconnecting said seat to the support frame, thereby positionably securing said seat to the support frame.

10. The retrofit height adjustable seat of claim 9, wherein said bracket includes a notch to removable receive said elastic member.

11. The retrofit height adjustable seat of claim 9, wherein said elastic member includes a base end for connection to the support frame, a handle end, and a fixably adjustable piece between said ends wherein said fixably adjustable piece provides a point of connection to said bracket and when said base end is connected to the support frame and said fixably adjustable piece is connected to said bracket, said elastic member is under tension to positionably retain said base to said support frame.

* * * * *